US009180952B2

(12) United States Patent
Buzzi

(10) Patent No.: US 9,180,952 B2
(45) Date of Patent: Nov. 10, 2015

(54) NAUTICAL VARIABLE STEERING AND PROPULSION ASSEMBLY

(71) Applicant: FB DESIGN S.R.L., Annone Brianza (IT)

(72) Inventor: Fabio Buzzi, Oggiono (IT)

(73) Assignee: FB DESIGN S.R.L., Annone Brianza (LC) (IT)

( * ) Notice: Subject to any disclaimer, the term of this patent is extended or adjusted under 35 U.S.C. 154(b) by 0 days.

(21) Appl. No.: 14/344,591

(22) PCT Filed: Sep. 27, 2012

(86) PCT No.: PCT/IB2012/055140
§ 371 (c)(1),
(2) Date: Mar. 12, 2014

(87) PCT Pub. No.: WO2013/046140
PCT Pub. Date: Apr. 4, 2013

(65) Prior Publication Data

US 2014/0190384 A1 Jul. 10, 2014

(30) Foreign Application Priority Data

Sep. 30, 2011 (IT) ..... MI2011A1771

(51) Int. Cl.

| | |
|---|---|
| ***B63H 25/04*** | (2006.01) |
| ***B63H 25/42*** | (2006.01) |
| ***B63B 1/24*** | (2006.01) |
| ***B63H 5/125*** | (2006.01) |
| ***B63H 5/07*** | (2006.01) |
| ***B63H 25/44*** | (2006.01) |

(52) U.S. Cl.
CPC ..... *B63H 25/42* (2013.01); *B63B 1/246* (2013.01); *B63H 5/07* (2013.01); *B63H 5/125* (2013.01); *B63H 25/44* (2013.01)

(58) Field of Classification Search
CPC ..... B63H 25/42; B63H 5/125; B63H 5/07; B63H 25/44; B63H 2025/00; B63H 2025/06; B63H 2025/38; B63H 2025/382; B63H 2025/385; B63H 2025/66; B63B 1/246
USPC ..... 114/144 R, 162; 440/49, 51, 53, 57, 440/61 S, 62, 63, 66, 79, 82
See application file for complete search history.

(56) References Cited

U.S. PATENT DOCUMENTS 3,707,939 A * 1/1973 Berg ..... 440/58
5,007,868 A 4/1991 Fry (Continued)

OTHER PUBLICATIONS

International Search Report in Corresponding PCT Application Dated Jan. 7, 2013.

*Primary Examiner* — Daniel V Venne
(74) *Attorney, Agent, or Firm* — Hedman & Costigan, P.C.; James V. Costigan; Kathleen A. Costigan

(57) ABSTRACT

A nautical variable-trim (10) steering and propulsion assembly that can be associated to the underside of the bottom (11) of a watercraft and in communication with a motor unit (12) located within said watercraft, said assembly (10) comprising a widened base (13) of resting on said watercraft, a shaft (14) connected on one side to said base (13) and on another side to a supporting torpedo-shaped element (15) defining the axis of rotation (16) of at least one propeller (17) set at least one end of said torpedo-shaped element (15), moreover being provided a directional fin-shaped skeg (18, 18') associated to said torpedo-shaped element (15) rotating about the axis of said shaft element (14) for controlling the directionality of said watercraft, characterized in that said directional fin-shaped skeg (18, 18') is in addition rotating about an axis parallel to said axis (16) of said at least one propeller (17).

6 Claims, 8 Drawing Sheets

(56) References Cited

U.S. PATENT DOCUMENTS

| | | | | |
|---|---|---|---|---|
| 5,277,632 | A | 1/1994 | Davis | |
| 5,772,481 | A | 6/1998 | Alexander, Jr. | |
| 7,435,147 | B1 * | 10/2008 | Eichinger | 440/78 |
| 2004/0139905 | A1 | 7/2004 | Chen | |
| 2007/0224892 | A1 * | 9/2007 | Davis | 440/68 |

* cited by examiner

PRIOR ART A

PRIOR ART B

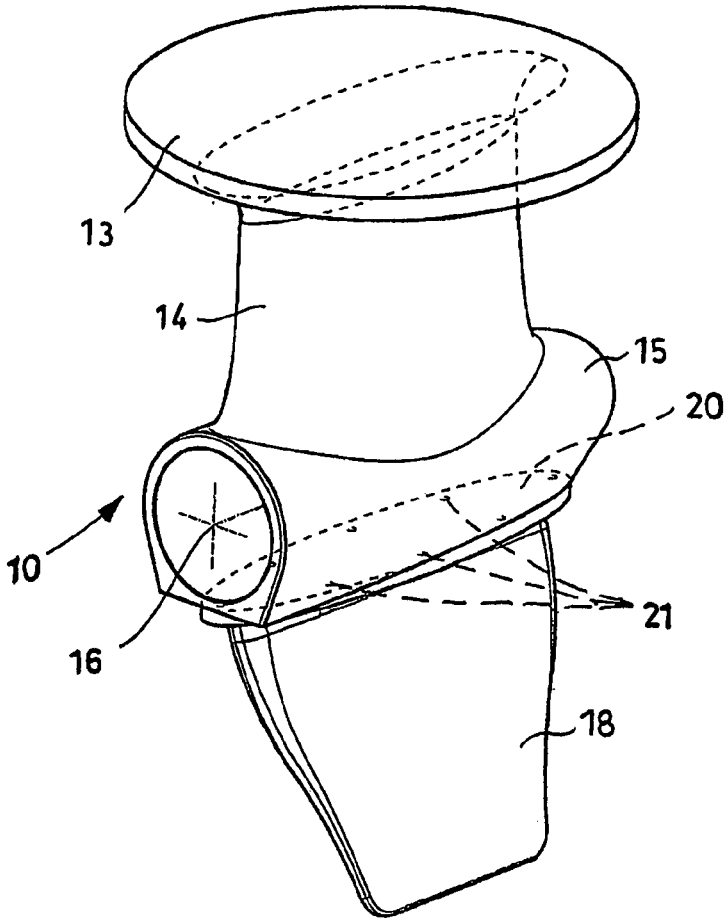
Fig. 4
Fig. 5
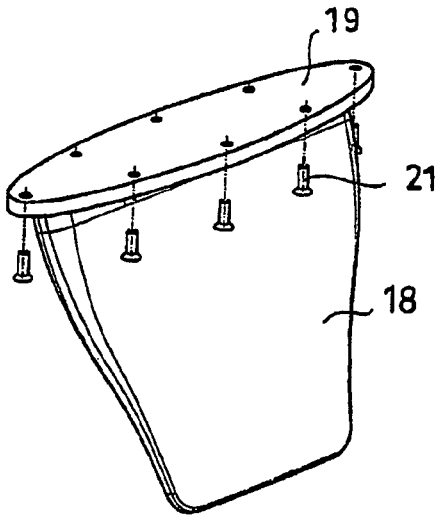

NAUTICAL VARIABLE STEERING AND PROPULSION ASSEMBLY

The present invention relates to a nautical variable steering and propulsion assembly.

In particular, the present invention relates to a nautical variable-trim steering and propulsion assembly known as "pod" transmission in the nautical sector.

These "pod" transmissions can be associated to the underside of the bottom of a watercraft and in communication with a motor unit located within said watercraft.

Specifically, the orientation-trim transmissions, or "pod", usually comprising a widened base for resting on the external surface of the watercraft and a shaft element connected on one side to the base and on another side connected to a trim or torpedo-shaped element.

This trim or torpedo-shaped element, so called because of the tapered shape thereof, supporting the axis of rotation, substantially horizontal, of at least one propeller, usually two.

Depending on the end of the torpedo-shaped element to which are associated the propellers, they are defined as tractor or thrusting.

On the underside of the trim or torpedo-shaped element is finally provided a directional fin-shaped skeg (in the following also "skeg").

In general, therefore, these transmissions so-called "pod", which in the nautical transmission sector for pleasure watercrafts are gaining more and more market shares, consist of a "z" transmission, that is, which uses two bevelled gears, passing through the bottom of the watercraft, adequately reinforced, rather than through the transom.

In the case of installations with two transmissions located symmetrically with respect to the longitudinal axis of the watercraft, a type of installation that can be assessed to correspond to 90% of the installations, the two "pod" transmissions are separate and independent, with steering controlled electronically.

In addition, these units gather thereto many functions that in a conventional transmission system are usually separated, such as the integral exhaust, the water intakes for the cooling system of the motor and the transmission.

Currently in production, there are two different types of "pod" transmissions.

In fact, a first known type provides tractor propellers, that is, the propulsion counter-rotating propellers are facing towards the bow of the watercraft.

The second type provides counter-rotating propellers of the thrusting type.

As mentioned above, both of these two "pod" transmission types provide the presence of a directional skeg fixed to the underside of the body of the "pod", which serves for the functionality of steering of the watercraft.

In the second type described, the skeg performs also a protective function of the propeller.

This skeg is located in the symmetry plane of the "pod" transmission and it is quite similar to that adopted also by the outboard motors and the inboard transmissions of the type so-called stern-drive.

FIG. 1 "prior art A" shows a first type of known "pod" transmission.

This embodiment is very versatile because it is installed by adapting perfectly at the bottom of the hull, with the considerable advantage of being able to be used on any hull, also in retrofit. The symmetry plane of this "pod" transmission is perpendicular to the bottom thereof.

This characteristic, irrelevant for the purpose of propulsion, has, however, the drawback that the directional skeg forms an angle with respect to the symmetry plane of the watercraft equal to angle $\alpha$ of the 'V' of the keel, existing in the installation section. It must be observed that this angle $\alpha$ is defined as the angle formed by the horizontal with the bottom of the watercraft and varies, section by section.

The efficiency of the skeg for the purposes of the directionality of the watercraft, therefore, is reduced, while the hydrodynamic lift thereof increases. The larger angle $\alpha$, the smaller the equivalent length of the skeg, the lower the efficiency, and the greater the lift generated by the directional skeg. With a simple trigonometric calculation, it can be established that the measured length on the vertical of the watercraft will be equal to the geometric length of the skeg multiplied by the cosine of angle $\alpha$ shown in FIG. 1 prior art A.

For a typical value of keel angle for gliding hulls in the installation transmission area, $\alpha=22°$ and, therefore, cos $\alpha=0.927$.

It must also be pointed out that the solution of the tractor propellers, exposed to any object that may be met at sea, it is very dangerous from the point of view of safety.

In FIG. 2 "prior art B", a second type of "pod" transmission is shown, which does not nave the defects mentioned above since it is installed vertically.

It can indeed be seen that the symmetry planes of the watercraft and of the "pod" transmission are parallel.

In this way, also the directional skeg is vertical, neutral from the point of view of hydrodynamic lift. As mentioned previously, the propellers are thrusting and protected from impact with semi-submerged objects by the body of the "pod" transmission thereof.

However, the mentioned "vertical" installation requires solving the problem of fixing the "pod" transmission to the hull and the passage through the bottom thereof.

The problem is currently solved by the introduction of a tunnel, that is, a cavity open towards the stern and recessed in relation to the otherwise continuous surface of the bottom, which allows obtaining a horizontal fixing plane.

The obvious drawbacks of this second prior art are the need to require a dedicated hull, the loss of hydrodynamic lift, in fact flows tend to rise, in correspondence of the tunnel and, finally, the space occupied in the engine room is greater, since the "pod" transmission is obviously mounted somewhat higher with respect to the case shown in FIG. 1 prior art A.

Moreover, the problem remains very relevant in the case in which a ship owner decides to re-power his watercraft, by modernising the propulsion system thereof: the structural changes to which it should be subjected would be much more expensive than in the case in which he would decide to adopt the transmission shown in FIG. 1 prior art A.

Therefore, in general no prior art provides the possibility of having a skeg associated to a watercraft of the type described in the preamble of claim 1, which is also movable in inclination with respect to an axis parallel to the axis of the propellers and fixable releasably in that inclination.

The documents of prior art U.S. Pat. No. 7,435,147, U.S. Pat. No. 3,707,939, U.S. Pat. No. 5,772,481, U.S. Pat. No. 5,277,632 and U.S. Pat. No. 5,007,368 represent only some examples of documents of prior art according to the preamble of claim 1.

In fact, none of these documents shows a skeg movable in inclination with respect to an axis parallel to the axis of the propellers.

On the contrary, the connections of these skegs with, the related torpedo-shaped elements are rigid and equipped with elements not in rotation but intended to be sacrificed, that is, intended to break in the event of a bump. Therefore, the skegs described in U.S. Pat. No. 7,435,147, U.S. Pat. No. 3,707,939, U.S. Pat. No. 5,772,481, U.S. Pat. No. 5,277,632, and U.S. Pat. No. 5,007,868 must necessarily be fixed in order not to lose the sacrificial ability of the constraints thereof.

Document US2004/139905 describes movable skegs installed on watercrafts entirely different with respect to those object of the preamble of claim 1.

That is not all! The skegs described in US2004/139905 are movable in rotation, but at the same time are not constrainable according to a desired inclination. In fact, object of this patent is precisely that of making to vary the inclination when the speed varies.

Even by combining US2004/139905 with the previously reported documents, the invention of the present application is not reached, since anyhow the presence of the releasable constraining means of the skeg in the inclined condition with respect to the torpedo-shaped element are missing.

Object of the present invention is to produce a nautical variable steering and propulsion assembly able to solve the above cited drawbacks of the prior art in an extremely simple, economical and particularly functional manner.

Another object is to produce a nautical variable steering and propulsion assembly that can be easily installed without compromising in any way the directionality of the watercraft.

These objects, according to the present invention, are achieved by producing a nautical variable steering and propulsion assembly as set forth in claim 1.

Further characteristics of the invention are highlighted by the dependent claims.

The characteristics and advantages of a nautical variable steering and propulsion assembly according to the present invention will become more apparent from the following illustrative and non-limiting description, referring to the attached schematic drawings wherein:

FIG. 1 prior art A shows a first, example of a nautical variable steering and propulsion assembly "pod" according to the prior art;

FIG. 2 prior art B shows a second example of a nautical variable steering and propulsion assembly "pod" according to the prior art;

FIGS. 3-5 show a first embodiment of a nautical variable steering and propulsion assembly "pod" according to the present invention;

Figures 1, 2:
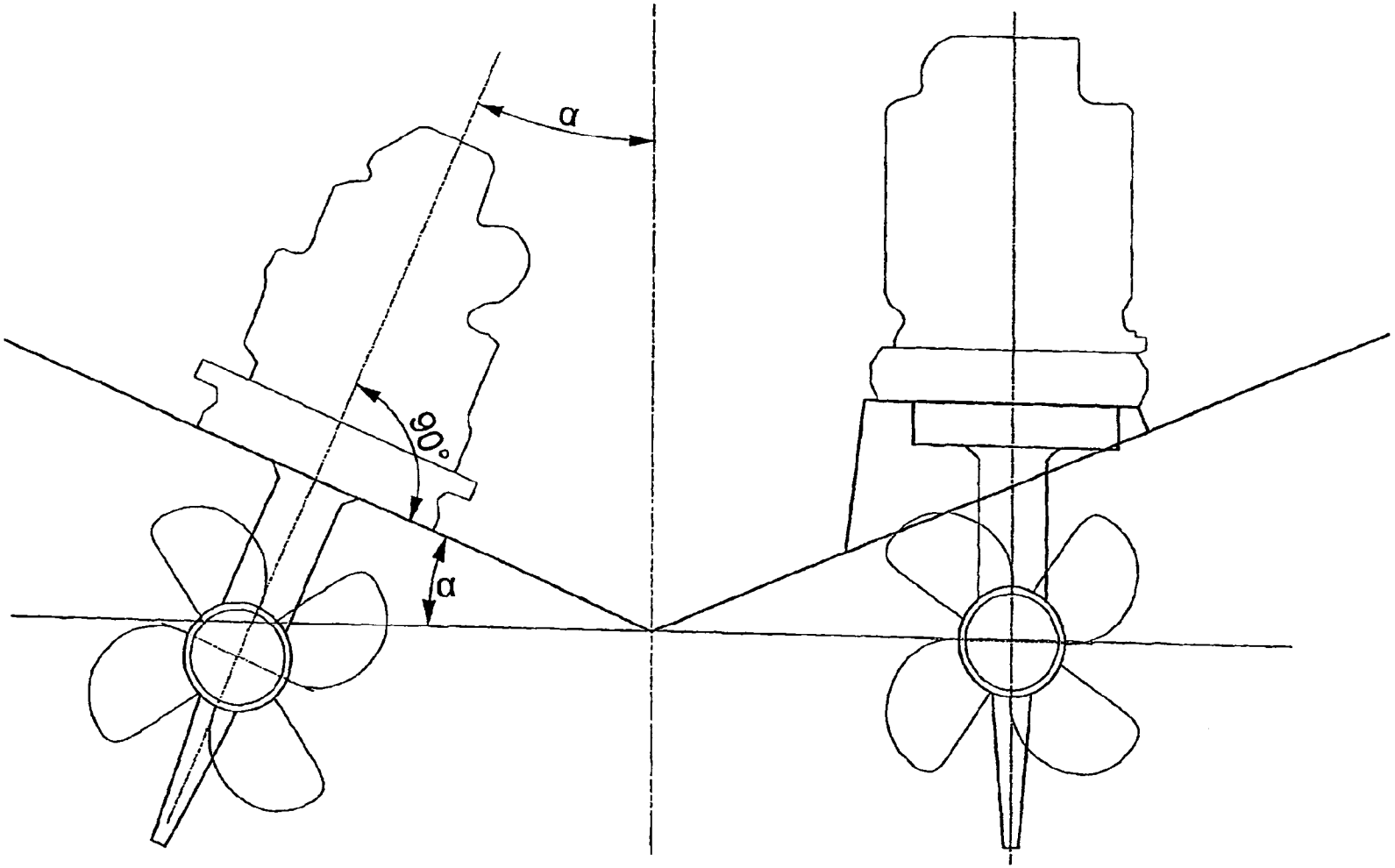

With reference to FIGS. 3-12, with 10 are indicated three different examples of nautical variable steering and propulsion assemblies according to the present invention.

These nautical variable steering and propulsion assemblies 10 are of the orientation-trim type, just like every other known "pod" transmission, they can be associated to the underside of the bottom 11 of a watercraft and in communication with a motor unit 12 located within the watercraft.

This assembly 10, just like the known "pod" transmissions, comprises a widened base 13 of support to the bottom 11 of the watercraft and a trim element 14 on one side connected to the base 13 and on another side connected to a trim or torpedo-shaped element 15.

The torpedo-shaped element 15 acts as a support for the rotation axis 16 of at least one propeller 17 arranged at least at one end of the torpedo-shaped element 15.

A directional fin-shaped skeg 18, 18' is provided that can be associated to the underside of the torpedo-shaped element 15.

For the purpose of the present invention, the number of propellers, and whether they are thrusting or tractor, is irrelevant.

In particular, according to the present invention, the assembly 10 also comprises means for modifying the orientation of the skeg 18, 18' with respect to the torpedo-shaped element 15 in such a way so that the skeg 18, 18' is not rotating only about the axis of the trim element 14 for controlling the directionality of said watercraft, but also about an axis parallel to the axis 16 of the at least one propeller 17 defined by the torpedo-shaped element 15.

In this way, the present invention allows to combine the advantages of both the existing solutions shown in FIGS. 1-2 prior art A and prior art B by eliminating the drawbacks. The assembly 10, object of this invention, in fact, is of the type that adapts to the bottom of the existing hull, the symmetry plane thereof is perpendicular to the bottom thereof, is fixed thereto by known means, such as bolting and use of watertight gaskets and at the same time provides adoption of a directional skeg fixed in such a way as to cancel the lift contribution generated by the shank of the assembly thereof, which is inclined with respect to verticality.

Figure 3:
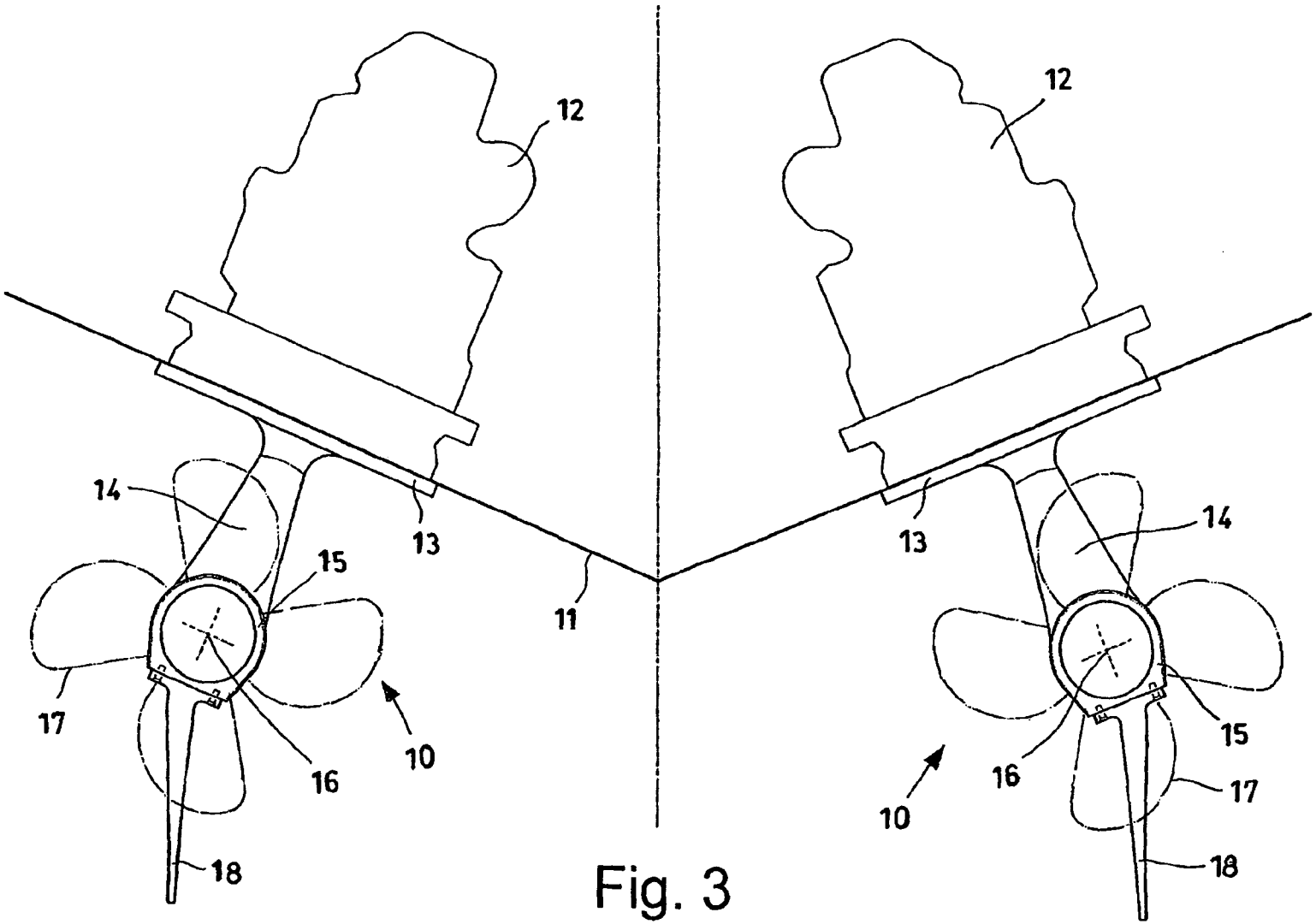

According to the first embodiment shown in FIGS. 3-5 the modifying means comprise means for releasable constraint of the skeg 18 with respect to the torpedo-shaped element 15 and a plurality of skegs 18 at different inclination.

Each of these skegs 18 is therefore selectively associable to the torpedo-shaped element 15 to produce an assembly 10 having a desired orientation.

This first embodiment provides therefore that it must be produced, for example cast or micro-cast, according to the adopted material, families of skegs, where each family is characterised in that the fixing surface is inclined according to prefixed angles, for example: 0°, 5°, 10°, 15°, 20°, 25°, 30° etc., with respect to verticality.

In this way, a vertical assembly is allowed, to obtain the maximum efficiency with respect to the directionality, or with such an angle as to make the assembly as neutral as possible under certain sailing conditions, for example, at cruising speed. The best angle will be chosen by practical tests and experience gained by the manufacturer of the transmissions and the shipyard users will allow reducing the stock of inclinations actually more used.

Suitable to this first embodiment will include two skeg variants. In the first case, the skeg to be installed to the left assembly 10 will be specular to that to be installed to the right assembly 10. In the second case, instead, the shape of the skeg 18 will be symmetrical, such as symmetrical will be the preset perforations for fixing to the torpedo-shaped element 15.

This simplification, by maintaining a near equal efficiency, allows using the same physical piece both for the left assembly 10 and for the right assembly, with industrial savings. Adoption of reversible fixing methods may allow later obtaining from the catalogue of the directional skegs.

To this effect, in FIGS. 4 and 5 is shown a skeg 18 inclined selectively that can be associated to the torpedo-shaped element 15 comprising a plane resting base 19 that can be coupled with a lateral plane portion 20 of the torpedo-shaped element 15.

It is being provided a plurality of bolt elements 21 for removable connection of the plane resting base 19 with the lateral plane portion 20 of the torpedo-shaped element 15.

Figure 6:
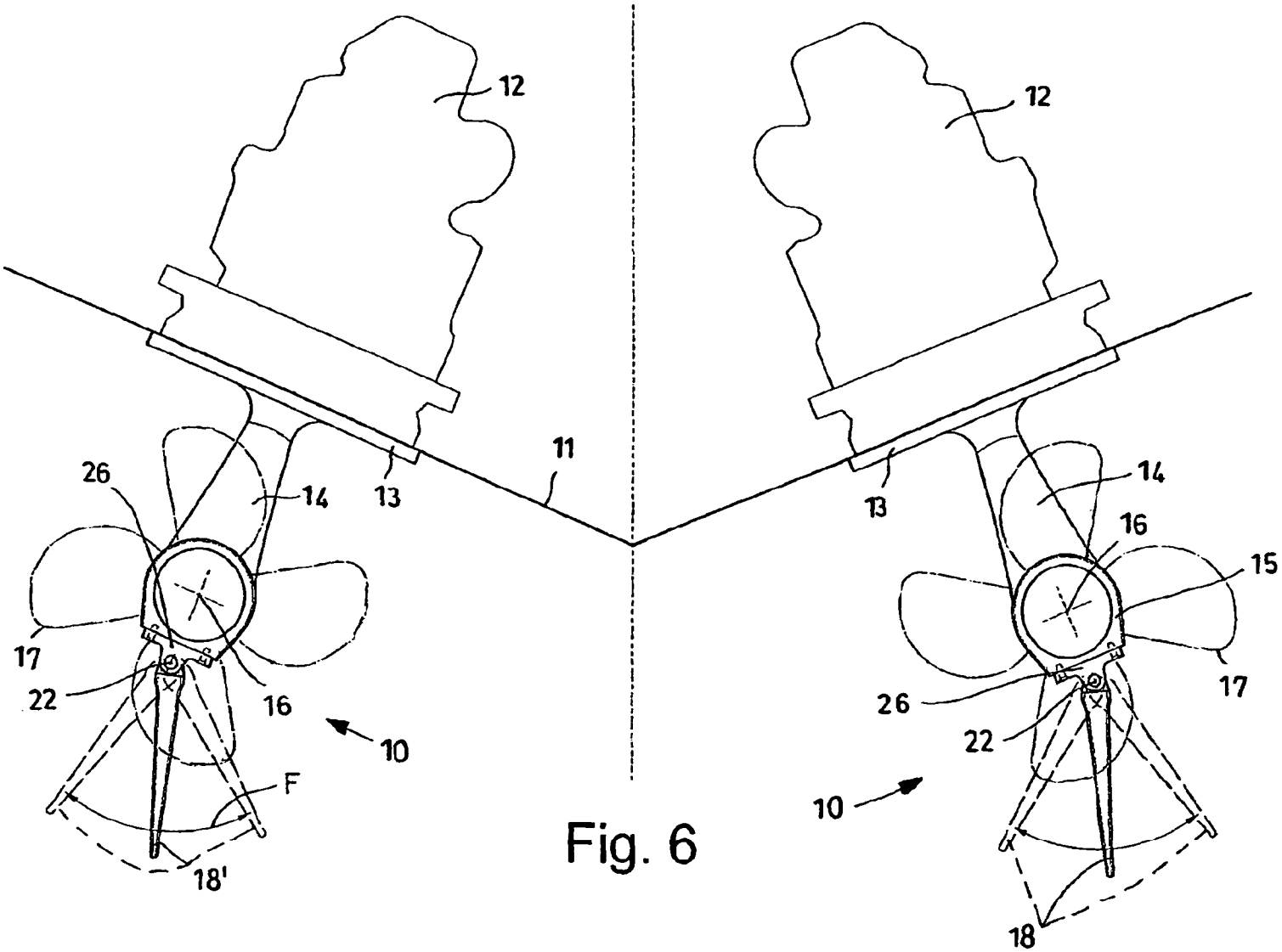
FIGS. 6-8 show a second embodiment of a nautical variable steering and propulsion assembly "pod" according to the present invention.
Figure 7:
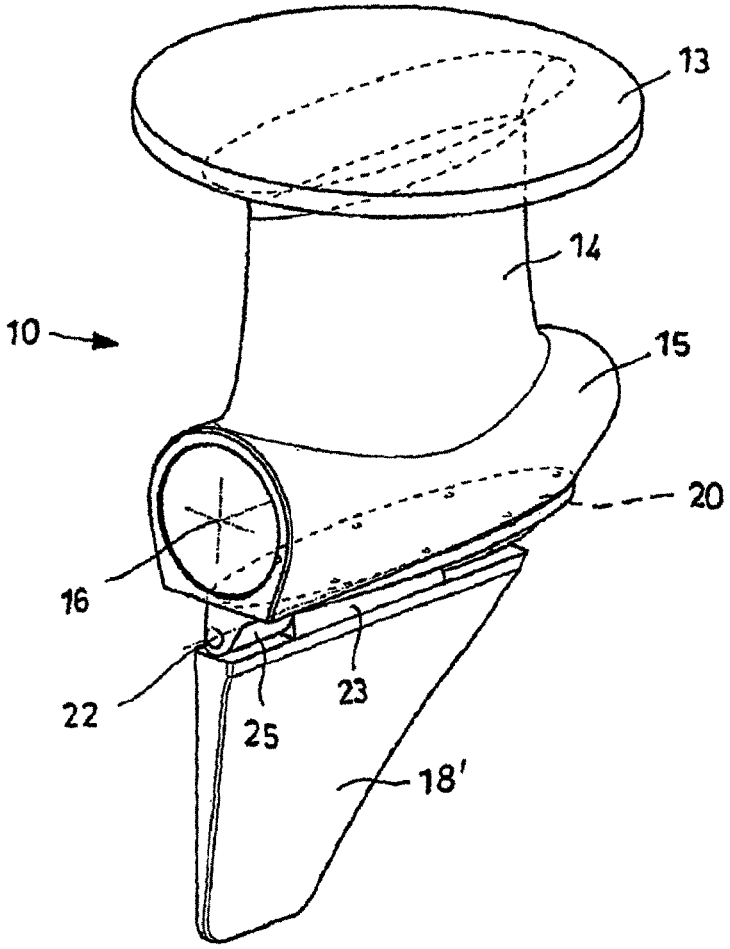
Figure 8:
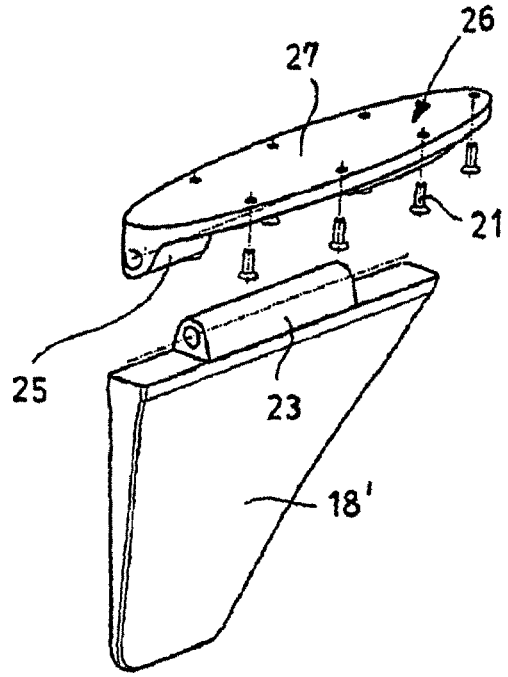
Figure 9:
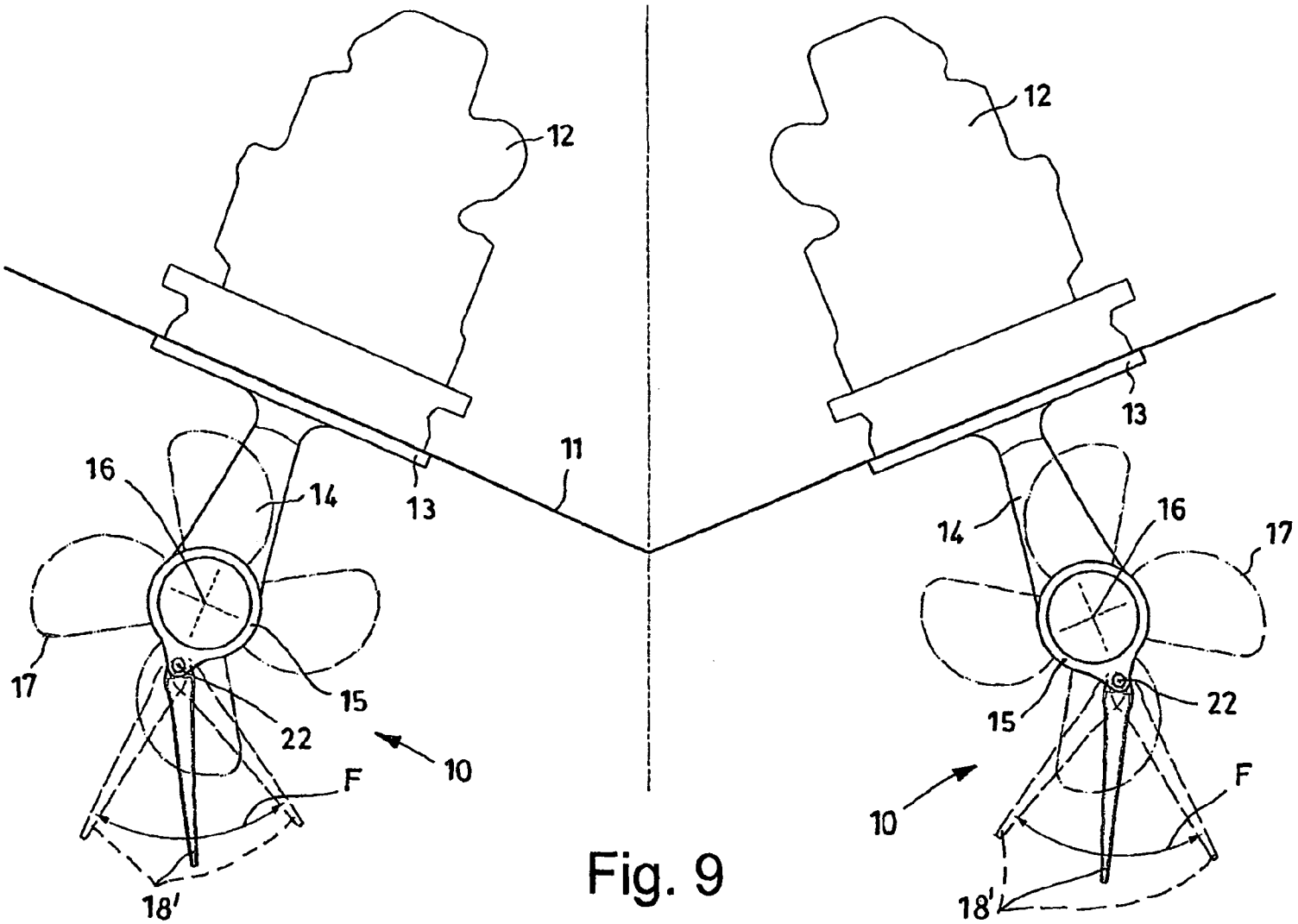
FIGS. 9-12 show a third embodiment of a nautical variable steering and propulsion assembly "pod" according to the present invention.
Figure 10:
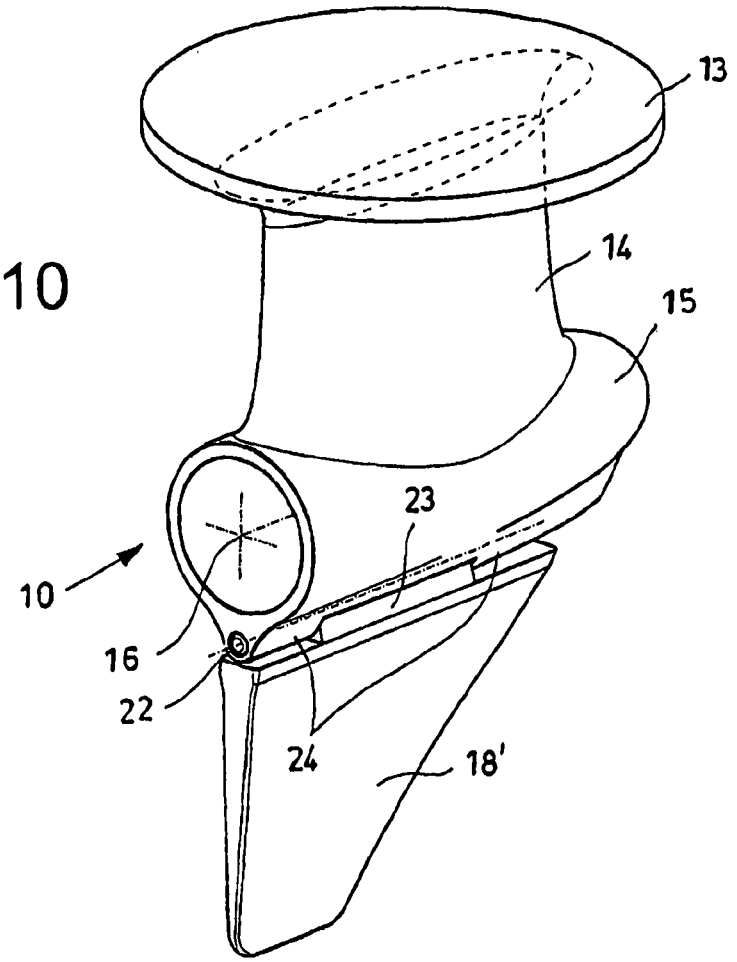
Figure 11:
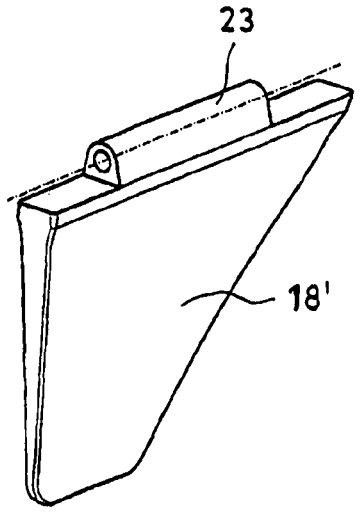
Figure 12:
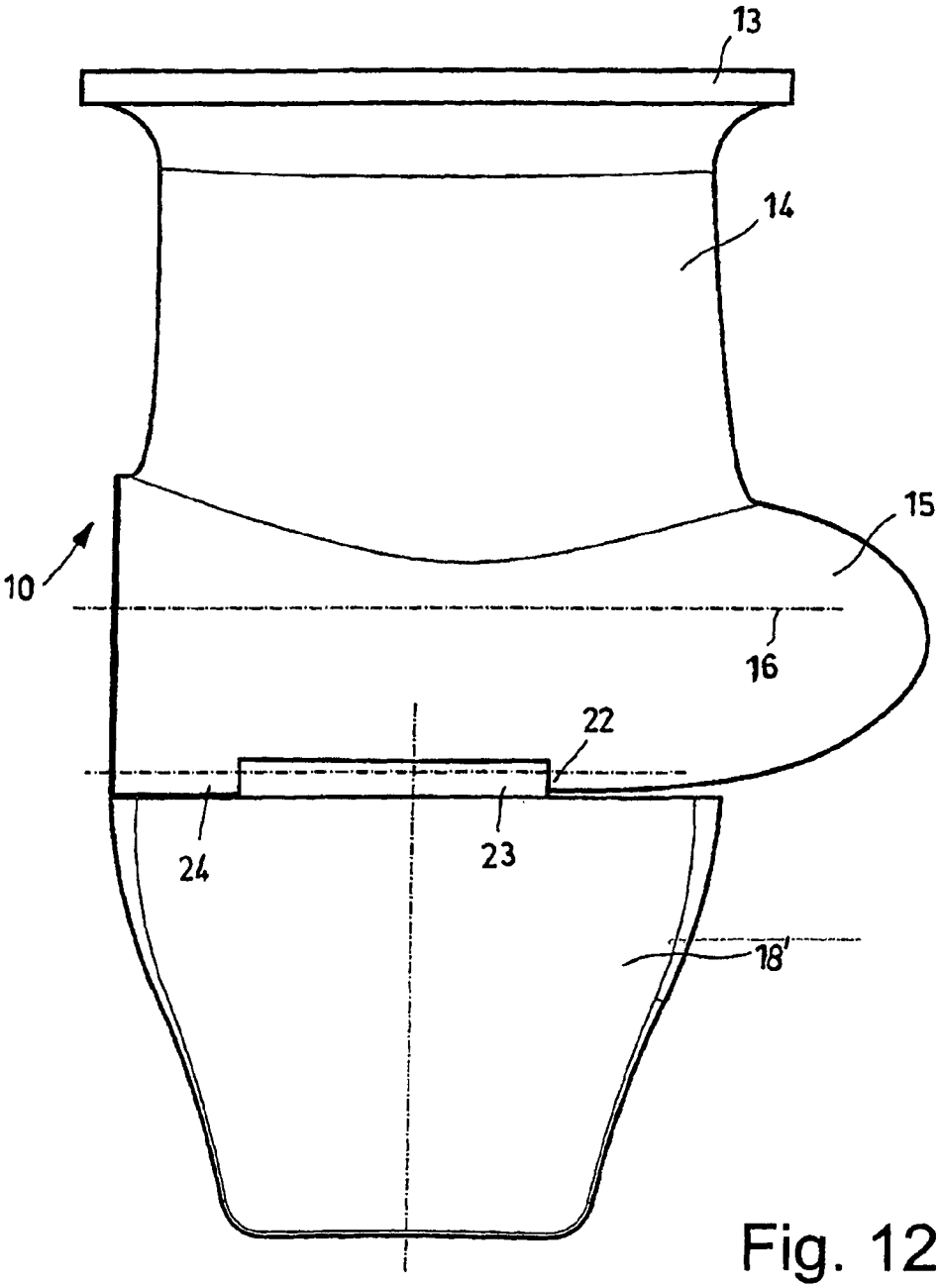

In FIGS. 6-8 a second embodiment is shown wherein the means for modifying the orientation of the skeg 18' with respect to the torpedo-shaped element 15 comprise pin coupling means between the skeg 18' and the torpedo-shaped element 15.

In particular, such coupling comprises a pin element 22 passing respectively in perforated portions 23, 24 of the skeg 18' and the torpedo-shaped element 15.

This second embodiment allows an adaptation for continuous and non-discrete angles as in the previous case. To the previously described fixing surface, instead of connecting a plate with a fixed directional skeg, a plane is constrained to which is hinged the directional skeg. Once determined the ideal angle for that particular installation, the skeg is locked, by known methods, such as welding or other means. If reversible fixing methods are used, it will be possible to take action and change the inclination later.

In FIGS. 9-12 is shown a third embodiment, of the general principle of the present invention.

Compared to the previous example, it is also envisaged an intermediate element 26 between the skeg 18' and the torpedo-shaped element 15.

The pin coupling therefore comprises a pin element 22 passing respectively in perforated portions 23, 25 of the skeg 18' and of the intermediate element 26.

Advantageously, the intermediate element 26 is removably constrained to the torpedo-shaped element 15 by means of a widened base 27 constraining with a lateral plane portion 20 of the torpedo-shaped element 15.

This third embodiment exploits a hinged directional plane, as in the variant of embodiment two, but in this latter case, the hinge is formed directly in the transmission body.

It is quite easy to understand the function of the nautical variable steering and propulsion assembly, object of the invention.

The assembly 10 of the present invention is in fact usable both in configuration of the tractor propellers and of the thrusting propellers and in both cases it is easily adaptable and can be assembled on any type of existing hull having a 'V' keel, for example according to known methods of watertight flanging.

At the same time, the assembly 10, by having a directional orientation fin-shaped skeg, allows maximising directionality, the turning capacity, and the safety of the watercraft or neutralise the hydrodynamic actions acting on the foot, under conditions of preset sailing.

Furthermore, in some shown examples, the directional skeg is made separately from the rest of the assembly 10 which in turn will be preset to receive it, for example by means of planes with threaded perforations or rotation hinge eyelets of the skeg.

It is thus seen that a nautical variable steering and propulsion assembly according to the present invention achieves the purposes outlined previously.

In fact, the nautical variable steering and propulsion assembly of the present invention can be easily installed without at the same time compromising in any way the directionality of the watercraft.

The nautical variable steering and propulsion assembly of the present invention thus designed is susceptible of several modifications and variations, all falling within the same inventive concept; moreover, all the details are susceptible to technically equivalent elements. In practice, the materials used, as well as their dimensions, may be of any type depending on the technical requirements.

The invention claimed is:

1. A nautical variable-trim steering and propulsion assembly (10) for association with an underside of a bottom (11) of a watercraft and in communication with a motor unit (12) located within said watercraft, said assembly (10) comprising a widened base (13) for resting on said watercraft, a shaft element (14) connected on one side to said widened base (13) and on another side to a supporting torpedo-shaped element (15) defining an axis of rotation (16) of at least one propeller (17) affixed at one end of said supporting torpedo-shaped element (15), moreover being provided a directional fin-shaped skeg (18, 18') connected to said supporting torpedo-shaped element (15), rotating about an axis of said shaft element (14) for controlling a direction of travel of said watercraft, characterised in that said directional fin-shaped skeg (18, 18') is in addition rotating about an axis parallel to said axis (16) of said at least one propeller (17) defined by said supporting torpedo-shaped element (15), being provided with a releasable constraint for constraining at least temporarily said directional fin-shaped skeg (18, 18') in an inclined position with respect to said supporting torpedo-shaped element (15).

2. The nautical variable-trim steering and propulsion assembly (10) according to claim 1, characterised in that said nautical variable-trim steering and propulsion assembly (10) is provided with a releasable constraint for modifying an orientation of said fin-shaped skeg (18') with respect to said supporting torpedo-shaped element (15) which comprises a pin coupling between said fin-shaped skeg (18') and said supporting torpedo-shaped element (15).

3. The nautical variable-trim steering and propulsion assembly (10) according to claim 2, characterised in that said pin coupling between said fin-shaped skeg (18') and said supporting torpedo-shaped element (15) comprises a pin element (22) passing in perforated portions (23, 24) of said fin-shaped skeg (18') and of said supporting torpedo-shaped element (15), respectively.

4. The nautical variable-trim steering and propulsion assembly (10) according to claim 2, characterised in that said nautical variable-trim steering and propulsion assembly comprises an intermediate element (26) for connection of said fin-shaped skeg (18') with said supporting torpedo-shaped element (15), said pin coupling comprising a pin element (22) passing in perforated portions (23, 25) of said fin-shaped skeg (18') and of said intermediate element (26), respectively, said intermediate element (26) being constrained to said supporting torpedo-shaped element (15).

5. The nautical variable-trim steering and propulsion assembly (10) according to claim 4, characterised in that said intermediate element (26) is removably constrained to said supporting torpedo-shaped element (15).

6. The nautical variable-trim steering and propulsion assembly (10) according to claim 5, characterised in that said intermediate element (26) comprises a widened base (27) for constraint with a lateral plane portion (20) of said supporting torpedo-shaped element (15), there being provided a plurality of bolt elements (21) for removable connection of said intermediate element (26) with said lateral plane portion (20) of said supporting torpedo-shaped element (15).

* * * * *